US011022256B2

(12) United States Patent
Ren et al.

(10) Patent No.: US 11,022,256 B2
(45) Date of Patent: Jun. 1, 2021

(54) LED LAMP

(71) Applicant: GE Lighting Solutions, LLC, East Cleveland, OH (US)

(72) Inventors: Xiaojun Ren, Shanghai (CN); Kun Xiao, Shanghai (CN); Yimin Zhu, Shanghai (CN); Zhifeng Bao, Xian (CN)

(73) Assignee: Savant Technologies LLC, East Cleveland, OH (US)

( * ) Notice: Subject to any disclaimer, the term of this patent is extended or adjusted under 35 U.S.C. 154(b) by 0 days.

(21) Appl. No.: 16/267,537

(22) Filed: Feb. 5, 2019

(65) Prior Publication Data

US 2019/0271442 A1 Sep. 5, 2019

(30) Foreign Application Priority Data

Mar. 5, 2018 (CN) ..... 201810189396.7

(51) Int. Cl.
*F21K 9/232* (2016.01)
*F21K 9/233* (2016.01)
(Continued)

(52) U.S. Cl.
CPC ..... *F21K 9/232* (2016.08); *F21K 9/233* (2016.08); *F21V 3/02* (2013.01); *F21V 3/06* (2018.02);
(Continued)

(58) Field of Classification Search
CPC ..... F21K 9/232; F21K 9/233; F21K 9/238; F21V 3/06; F21V 31/005; F21V 29/85;
(Continued)

(56) References Cited

U.S. PATENT DOCUMENTS 4,673,840 A * 6/1987 Gates ..... H01K 1/34 313/25
6,262,534 B1 * 7/2001 Johnson, Jr. ..... H01J 61/34 313/26
(Continued)

FOREIGN PATENT DOCUMENTS

CN 202349655 U 7/2012
CN 103080631 A * 5/2013 ..... F21V 29/85
(Continued)

OTHER PUBLICATIONS

Machine English Translation of JP2012191114A, Ohata; Oct. 2012 (Year: 2012).*
(Continued)

*Primary Examiner* — Rajarshi Chakraborty
*Assistant Examiner* — Glenn D Zimmerman
(74) *Attorney, Agent, or Firm* — Wood IP LLC

(57) ABSTRACT

An LED lamp, comprising a base; a lamp envelope coupled to the base; a support module accommodated in the lamp envelope, a first inner cavity being formed between the support module and the lamp envelope, the first inner cavity containing therein a first gas medium; a driver module accommodated in the first inner cavity and coupled to the support module; and an LED inner vessel accommodated in the first inner cavity and coupled to at least one of the support module and the driver module, a sealed second inner cavity being formed within the LED inner vessel, and the second inner cavity containing therein a second gas medium and an LED light source module.

14 Claims, 4 Drawing Sheets

(51) Int. Cl.

| | |
|---|---|
| ***F21V 3/02*** | (2006.01) |
| ***F21V 29/60*** | (2015.01) |
| ***F21V 29/85*** | (2015.01) |
| ***F21V 31/00*** | (2006.01) |
| ***F21V 3/06*** | (2018.01) |
| *F21Y 115/10* | (2016.01) |

(52) U.S. Cl.
CPC ..... *F21V 29/60* (2015.01); *F21V 29/85* (2015.01); *F21V 31/005* (2013.01); *F21Y 2115/10* (2016.08)

(58) Field of Classification Search
CPC ..... F21V 29/60; F21V 3/02; F21V 23/006; F21V 23/003; F21V 19/0025; F21Y 2115/10
See application file for complete search history.

(56) References Cited

U.S. PATENT DOCUMENTS

| | | | | |
|---|---|---|---|---|
| 7,329,993 | B2 | 2/2008 | Fulop | |
| 9,353,937 | B2 | 5/2016 | Hussell et al. | |
| 9,482,421 | B2 | 11/2016 | Negley | |
| 10,197,260 | B2 | 2/2019 | Chen et al. | |
| 2004/0201990 | A1* | 10/2004 | Meyer | F21V 29/58 362/255 |
| 2006/0171151 | A1* | 8/2006 | Park | H01L 33/60 362/327 |
| 2006/0181207 | A1* | 8/2006 | Claassen | H01K 1/14 313/579 |
| 2012/0230034 | A1* | 9/2012 | Boomgaarden | F21V 3/02 362/294 |
| 2013/0141892 | A1 | 6/2013 | Okazaki et al. | |
| 2013/0170175 | A1* | 7/2013 | Negley | F21K 9/232 362/84 |
| 2013/0240937 | A1* | 9/2013 | Chae | H01L 33/46 257/98 |
| 2013/0271987 | A1* | 10/2013 | Hussell | F21V 29/85 362/249.02 |
| 2014/0159077 | A1* | 6/2014 | Kuenzler | H05B 45/00 257/89 |
| 2016/0316538 | A1* | 10/2016 | Saes | H05B 47/105 |
| 2017/0276340 | A1* | 9/2017 | Chen | F21K 9/238 |
| 2018/0347766 | A1* | 12/2018 | Choi | F21K 9/237 |
| 2019/0264900 | A1* | 8/2019 | Yao | F21K 9/272 |
| 2019/0267521 | A1* | 8/2019 | Corazza | H01L 23/26 |

FOREIGN PATENT DOCUMENTS

| | | | | |
|---|---|---|---|---|
| CN | 103080631 | A | 5/2013 | |
| CN | 203595009 | U | 5/2014 | |
| CN | 1649079 | A | 11/2014 | |
| CN | 104136836 | A | 11/2014 | |
| CN | 104412028 | A | 3/2015 | |
| CN | 105351777 | A | 2/2016 | |
| JP | 2012191114 | A * | 10/2012 | H01L 25/9753 |
| WO | 2004084258 | A2 | 9/2004 | |
| WO | WO-2017141159 | A1 * | 8/2017 | B01J 20/18 |

OTHER PUBLICATIONS

First Office Action for Chinese Patent Appl. No. 201810189396.7, dated Mar. 18, 2020, 15 pages.
Third Office Action for Chinese Patent Appl. No. 201810189396.7, dated Mar. 2, 2021, 7 pages.

* cited by examiner

LED LAMP

TECHNICAL FIELD

The present invention relates to an LED lamp, in particular a glass bulb LED lamp with a double-layer sealing structure.

BACKGROUND

Conventional incandescent bulbs and halogen bulbs energize the resistance wire and heat the filament to very high temperatures to produce visible light, typically including a transparent glass envelope, a filament, a glass stem with a sealed wire, and a base. Although such lamps are relatively inexpensive and have a light distribution close to full angle, their service life and energy efficiency are not high. In recent years, LED lamps have many advantages such as high energy efficiency, long service life, compact size, and environmentally friendly. It has been proposed to combine LED light sources with traditional glass bulbs in order to superimpose their advantages.

In the existing glass bulb LED lamp, the LED light source and the driver module are all disposed inside the glass bulb, and after filling the gas cooling medium, the glass bulb is sealed. When the LED lamp is working, some electronic components inside the glass bulb, such as the driver module, will generate a certain amount of heat, such that the packaging material, solder, insulating material, and adhesive on the LED emit a certain amount of volatile organic compound (VOC) particles. These volatile organic compound particles are deposited on the surface of the high-temperature LED chip, which reduces the luminous efficiency of the LED chip. On the other hand, the deposit also affects the heat dissipation of the LED chip such that the LED chip is being used in a high temperature environment for a long time, thereby reducing its service life and stability.

Therefore, it is necessary to provide a new type of LED lamp to solve at least one of the above problems.

SUMMARY

The present invention provides an LED lamp comprising a base; a lamp envelope coupled to the base; a support module accommodated in the lamp envelope, a first inner cavity being formed between the support module and the lamp envelope, the first inner cavity containing therein a first gas medium; a driver module accommodated in the first inner cavity and coupled to the support module; and an LED inner vessel accommodated in the first inner cavity and coupled to at least one of the support module and the driver module, a sealed second inner cavity being formed within the LED inner vessel, and the second inner cavity containing therein a second gas medium and an LED light source module.

One of the purposes of the present application is to provide a new LED lamp having a double-layer sealing structure capable of arranging the LED light source in a space independent of the driver module, to avoid contamination by the VOC generated by the driver module.

BRIEF DESCRIPTION OF DRAWINGS

These and other features, aspects and advantages of the present invention will become better understood when the following detailed description is read with reference to the accompanying drawings, in which like reference numerals are used throughout the drawings to refer to like parts, where.

DETAILED DESCRIPTION OF EMBODIMENTS

Unless otherwise defined, the technical and scientific terms used in the claims and the specification are as they are usually understood by those skilled in the art to which the present invention pertains. "First", "second" and similar words used in the specification and the claims do not denote any order, quantity or importance, but are merely intended to distinguish between different constituents. The terms "one", "a" and similar words are not meant to be limiting, but rather denote the presence of at least one. The approximate language used herein can be used for quantitative expressions, indicating that there is a certain amount of variation that can be allowed without changing the basic functions. Thus, numerical values that are corrected by language such as "approximately" or "about" are not limited to the exact value itself. Similarly, the terms "one", "a", and similar words are not meant to be limiting, but rather denote the presence of at least one. "Comprising", "consisting", and similar words mean that elements or articles appearing before "comprising" or "consisting" include the elements or articles and their equivalent elements appearing behind "comprising" or "consisting", not excluding any other elements or articles. "Connected", "connection", "coupled", and similar words are not limited to a physical or mechanical connection, but may include direct or indirect electrical connections, thermal connections, thermally conductive connections, and thermally transmissive connections.

Figure 1:
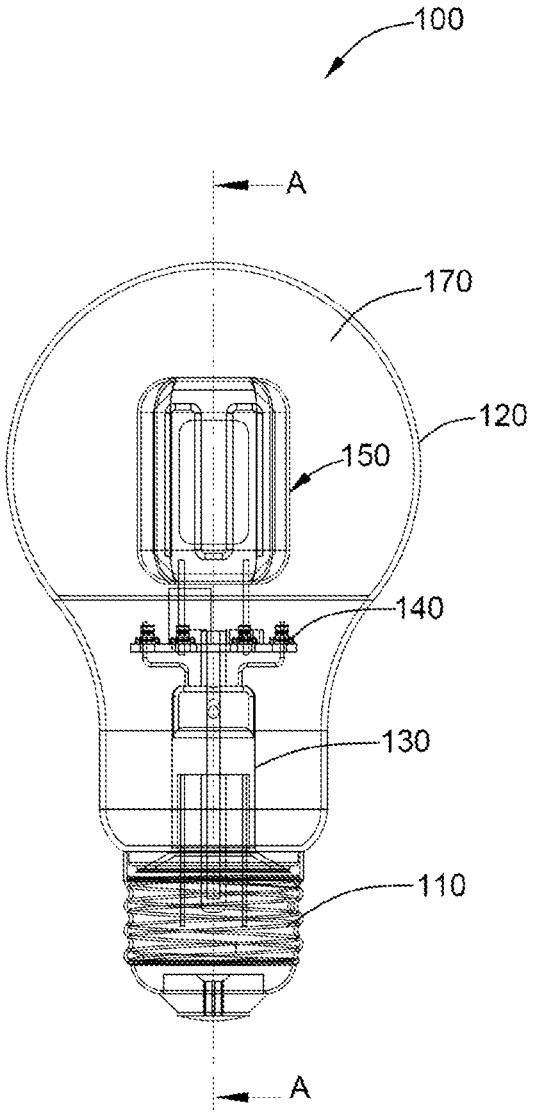
FIG. 1 is a front view showing an LED lamp according to an embodiment of the present invention.
Figure 2:
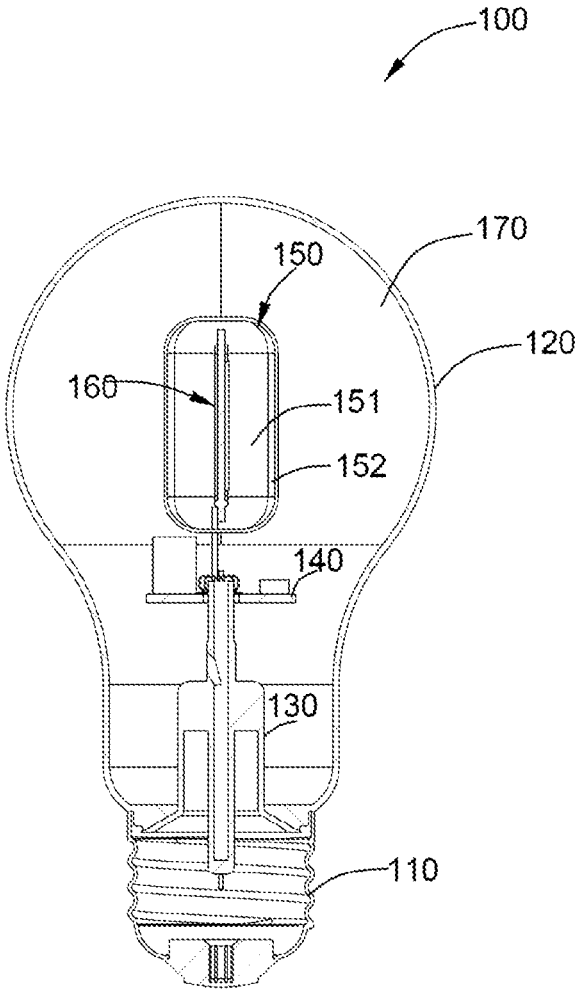
FIG. 2 is a cross-sectional view of the LED lamp of FIG. 1 taken along line A-A.
Figure 3:
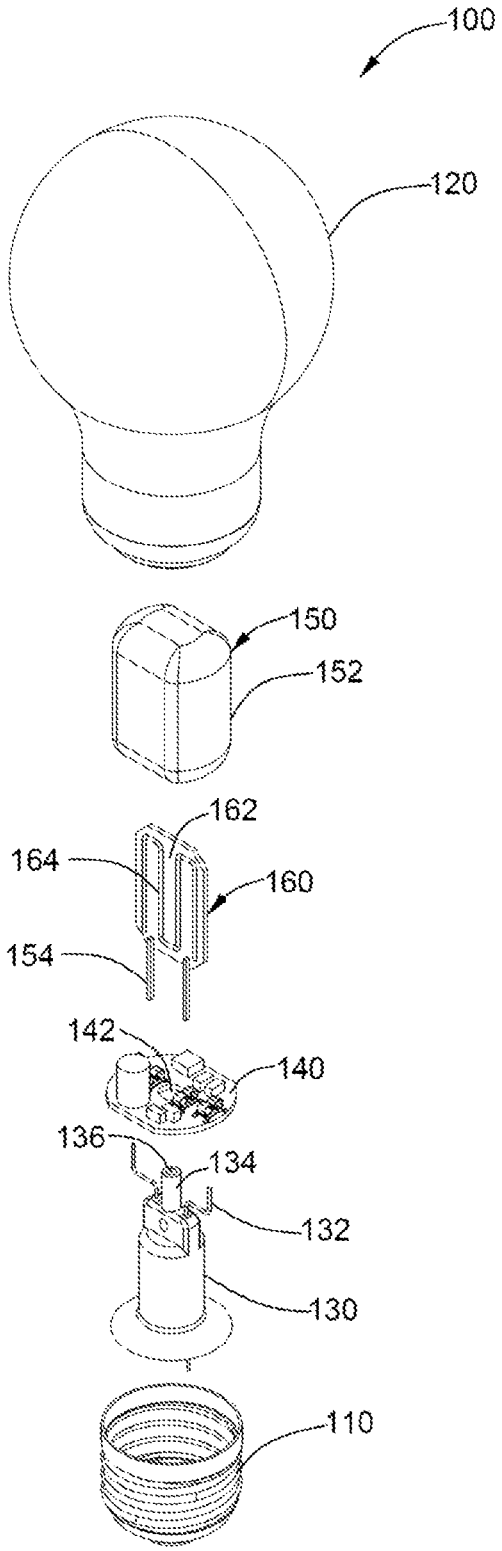
FIG. 3 is an exploded perspective view of the LED lamp of FIG. 1.

FIG. 1 is a front view of an LED lamp 100 according to an embodiment of the present invention, FIG. 2 is a cross-sectional view of the LED lamp 100 of FIG. 1 taken along line AA, and FIG. 3 is an exploded perspective view of the LED lamp 100 from FIG. 1. The LED lamp 100 comprises a base 110, a lamp envelope 120, a support module 130, a driver module 140, and an LED inner vessel 150.

The base 110 is configured to connect with an external power source; in some embodiments of the present application, the base 110 is a standardized screw; in other embodiments, the base may be of other types, such as a plug-in base or a bayonet mount.

The lamp envelope 120 is a hollow structure; in the embodiment shown in FIG. 1, the lamp envelope 120 has the same appearance as the existing incandescent lamp, and comprises a substantially spherical top portion and a substantially hollow cylindrical bottom portion at the lower end of the top portion. In an embodiment that is not restricted, the lamp envelope may also be candle-shaped, a cylinder, an inverted cone, or the like. The support module 130 is received in the lamp envelope 120 and coupled to the lamp envelope 120 to form a first inner cavity 170 between the support module 130 and the lamp envelope 120; the driver module 140 and the LED inner vessel 150 are received in the first inner cavity 170. The lamp envelope 120 may be made of a light transmissive material; in some embodiments, the lamp envelope 120 is made of transparent glass, and the support module 130 is a column made out of glass; the bottom of the support module 130 is coupled to the bottom of the lamp envelope 120 through high-temperature melting. In other embodiments, the lamp envelope 120 can also be made out of clear plastic or transparent ceramic. The first inner cavity 170 has a first gas medium for cooling the electronic components housed therein, wherein the first gas medium is selected from at least one of helium gas and hydrogen gas. In some embodiments, the first gas medium comprises helium and oxygen for cooling, and the oxygen is used to react with VOC (Volatile Organic Compounds) generated by the driver module 140, to reduce the effect of VOC on the driver module 140 itself or other electronic components, prevent VOC contamination, and prevent the decomposition of ITO (Indium Tin Oxides) on the LED chip. The volume ratio of oxygen to helium is about (2.5-50):(50-97.5). In a preferred embodiment, the volume ratio of oxygen to helium is about (2.5-20):(80-97.5). In some embodiments, the first gas medium may comprise a combination of hydrogen and helium that has a better cooling effect, wherein the volume ratio of hydrogen to helium is about (2-10):(90-98).

In some embodiments, the bottom of the lamp envelope 120 that is coupled to the support module 130 is secured to the base 110 using an adhesive.

Referring to FIG. 1 and FIG. 3, the support module 130 comprises a pair of metal pins 132; one end of the support module 130 is electrically connected to the base 110, and the other end is coupled to the driver module 140 through the metal pin 132 to supply power to the driver module 140. In some embodiments, the support module 130 further comprises at least one fixing unit 134 inserted into the fixing hole 142 of the driver module 140. The support module 130 supports and secures the driver module 140 by binding the metal pins 132 and the fixing unit 134. The support module 130 and the driver module 140 are connected by the metal pins 132, which avoids the use of welding, realizes the electrical connection, and is easy to install.

In the embodiment shown in FIG. 3, the LED inner vessel 150 is coupled and secured to the driver module 140, while the driver module 140 is coupled and secured to the support module 130. The LED inner vessel comprises a housing 152, an LED light source module 160, and a pair of metal pins 154. The second metal pin 154 is coupled to the LED light source module 160 at one end and to the driver module 140 at the other end for securing the LED inner vessel 150 to the driver module 140 and supplying power to the LED light source module through the metal pin 154. In other embodiments, the LED inner vessel 150 may be directly coupled and secured to the support module 130, supported by the support module 130, while the LED inner vessel 150 and the driver module 140 are electrically connected by wires or through other similar methods.

In some embodiments, the driver module 140 may comprise a communication module for receiving and/or transmitting signals; the communication module comprises but is not limited to a microwave communication module, a Bluetooth communication module, a Wi-Fi communication module, a mobile device, a General Packet Radio Service technology communication module, and a Zigbee communication module.

Referring to FIG. 2 and FIG. 3, a sealed second inner cavity 151 is formed within the LED inner vessel 150, the second inner cavity containing therein a second gas medium, and an LED light source module 160 is received in the second inner cavity 151. The LED light source module 160 comprises a support unit and a plurality of LED chips 164 mounted on the support unit; the LED chip 164 is covered with phosphor; in an unrestricted embodiment, the phosphor is mixed in the silica gel and then covers the LED chip 164. In some embodiments, the support unit is a support plate 162 as shown in FIG. 3, and the LED chip 164 can be mounted on one mounting surface or two opposite mounting surfaces of the support plate 162. In some embodiments, the support unit comprises at least one support column assembled together, the LED chip is mounted on the support column, and the phosphor covers the support column on which the LED chip is mounted, wherein the number of support columns can be set, but is not limited to, 4, 5, 6, 7 or more based on the intensity requirements of the light.

In some embodiments, the LED chips 164 on the support plate 162 are more discretely installed, such as on an S-type or M-type tracks, such that the heat generated by the plurality of LED chips 164 can be more easily dispersed.

It is known that when the LED lamp 100 is in operation, the heat from the driver module 140 itself causes a certain amount of VOC to be emitted within the lamp envelope by the encapsulating material, the solder, the insulating material, and the adhesive thereon. The sealed second inner cavity 151 houses the LED light source module 160 therein, avoiding the deposition of VOC on the surface of the LED chip 164, and maintaining the luminous efficiency and heat dissipation performance of the LED chip 164. The housing of the LED inner vessel can be machined into any regular or irregular shape that can serve as an internal seal, including but not limited to hollow cubes, hollow cuboids, hollow spheres, and hollow ellipsoids. In the embodiment shown in FIG. 3, in order to make the plurality of LED chips 164 mounted on the support plate 162 to be as close as possible to the housing in order to reduce the heat transfer distance, the housing of the LED inner vessel 150 is selected to be a hollow cuboid, wherein the LED chip 164 is approximately the same distance from the housing 150, which is 2 to 10 mm. The housing is housed in a first inner cavity 170 having a first gas medium; the housing and the support plate 162 of the LED inner vessel 150 are designed to achieve a better heat dissipation effect for the LED chip 164. In the embodiment shown in FIG. 4, the housing 452 of the LED inner vessel 450 of the LED lamp 400 may be a hollow sphere that is easy to machine. In some embodiments, the material of the housing of the LED inner vessel 150 is arbitrarily transparent and is able to seal other materials including, but not limited to, transparent hard glass, transparent quartz glass, and transparent soft glass.

In some embodiments, the support unit comprises at least one support column assembled together, and the shape of the housing of the LED inner vessel may be correspondingly designed according to the structure of the support unit, e.g., at least one support column is assembled into a structure resembling a circular platform, and the LED inner vessel may be correspondingly designed as a circular platform or a conical structure.

Figure 4:
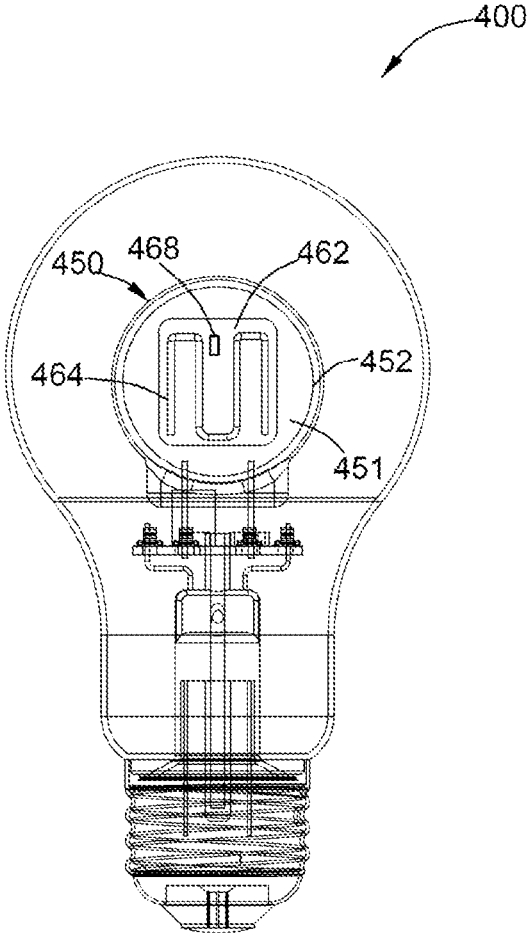
FIG. 4 is a front view of an LED lamp according to another embodiment of the present invention.

The second gas medium present in the LED inner vessel is selected from the group consisting of oxygen, helium, hydrogen, or their combinations thereof. In some embodiments, the LED inner vessel also comprises a substance that can release these gas media. In some embodiments, the composition of the second gas medium can be the same as the first gas medium. Referring to FIG. 4, in some embodiments, the material of the support unit 462 of the LED inner vessel 450 is organic, such as polyimide (PI), or a metal-organic composite material, while the heat generated by the LED chip 464 during operation may cause the support unit 462 to emit a certain amount of VOC, which may diffuse into the second inner cavity 451 and affect the illumination and heat dissipation of the LED chip 464. In this case, the second gas medium may be selected from a composition comprising helium and oxygen, wherein the oxygen may react with the VOC to reduce the effect of the VOC on the LED chip 464 while preventing decomposition of the ITO on the LED chip. In some embodiments, the material of the support unit 462 of the LED inner vessel 450 is selected from the group consisting of glass, metal, ceramic, or sapphire, while the second gas medium may be selected from a composition comprising helium gas and hydrogen gas with a higher cooling efficiency. In some other embodiments, the material of the support unit 462 of the LED inner vessel 450 is selected from the group consisting of glass, metal, ceramic or, sapphire, while the second gas medium may optionally comprise a combination of helium and oxygen, wherein oxygen can prevent the decomposition of ITO on the LED chip.

In some embodiments, the second gas medium comprises helium gas and hydrogen gas, wherein the hydrogen gas may be directly mixed with the helium gas to be filled into the LED inner vessel as the second gas medium, or may be released by the hydrogen gas releasing agent under the action of electromagnetic waves. As shown in FIG. 4, a hydrogen releasing agent 468 is mounted on a support unit 462, which can release hydrogen under infrared irradiation and is mixed with existing helium gas for cooling the LED chip 464.

Referring to FIG. 1 to FIG. 3, an assembly method of an LED lamp 100 according to an embodiment of the present invention is introduced: (1) a plurality of LED chips 164 are more discretely mounted on a support plate 162, and the phosphor is mixed in a silica gel to cover a plurality of LED chips 164. (2) One end of a pair of metal pins 154 is mounted on the support plate 162, while the support plate 162 on which the LED chips 164 are mounted and the partial metal pins 154 are sealed into the second inner cavity 151 of the housing 152, in an atmosphere or environment filled with the second gas medium, forming an LED inner vessel 150, whereby the other end of the metal pin 154 is suspended outside the housing 152. (3) The driver module 140 is mounted to the support module 130 through the metal pins 132 and the fixing unit 134, while the LED inner vessel 150 is mounted to the driver module 140 through the metal pins 154. (4) The combined structure of the LED inner vessel 150, the driver module 140 and the support module 130 is incorporated into the hollow lamp envelope 120, while the bottom of the support module 130 and the bottom of the lamp envelope 120 are seamlessly coupled together through high-temperature melting. The first inner cavity 170 is formed between the support module 130 and the lamp envelope 120; the LED inner vessel 150 and the driver module 140 are received in the first inner cavity 170. (5) The fixing unit 134 further comprises a charging and exhausting port 136 for filling the first inner cavity 170 and then charging the first gas medium; after filling the first gas medium, the filling is performed by using a hot melting method; the exhaust port 136 is sealed such that there is no gas exchange between the first inner cavity 170 and the outside. (6) The lamp envelope 120 is bonded to the base 110 using an adhesive while the metal pins 132 of the support module 130 and the base 110 are connected together using wires or other conductive structures, in order to realize the electrical connection between the base and the driver module 140.

In the embodiment of the present invention, the LED light source module 160 is received in the sealed second inner cavity 151 by the LED inner vessel 150, which can effectively isolate the impact of organic volatile matter on the LED light source module 160 generated by the driver module 140 or other electronic modules. Also, the driver module 140 is mounted and secured to the support module 130 and the metal pin 154 using the metal pin 132, in order to mount and secure the LED inner vessel 150 to the driver module 140, thereby realizing an electrical connection and avoiding complicated methods such as welding, as well as simplifying the manufacturing and assembly process of the LED lamp 100.

The description uses specific embodiments to describe the present invention, including the best mode, and can help any person skilled in the art perform experimental operations. These operations include using any device and system and using any specific method. The patentable scope of the present invention is defined by the claims, and may include other examples that occur in the art. Other examples are considered to be within the scope of the claims of the invention if they are not structurally different from the literal language of the claims or they have equivalent structures as described in the claims.

The invention claimed is:

1. A LED lamp, comprising:

a base configured for connection to a power source;

a lamp envelope coupled to the base;

a support module having a bottom end electrically connected to the base and a top end comprising at least one metal pin and at least one fixing device;

a first inner cavity being formed between the support module and the lamp envelope, the first inner cavity containing therein a first gas medium;

wherein the at least one fixing device is configured for filling the first inner cavity and charging the first gas medium;

a driver module (i) being accommodated in the first inner cavity and (ii) having a top end connected to a LED inner vessel accommodated in the first inner cavity and a bottom end mounted to the support module; and a closed second inner cavity being formed within the LED inner vessel the second inner cavity containing therein a second gas medium and a LED light source module;

wherein, the driver module is mounted and secured to the support module by (i) coupling the at least one metal pin to the driver module and (ii) inserting the at least one fixing device into a fixing hole of the driver module; and wherein, the driver module is disposed outside of the second inner cavity.

2. The LED lamp according to claim 1, wherein the support module is configured to supply electricity to the driver module via the at least one metal pin.

3. The LED lamp according to claim 1, wherein the LED inner vessel comprises at least one metal pin, one end of the metal pin coupled to the LED light source module and the other end coupled to the driver module.

4. The LED lamp according to claim 1, wherein the first gas medium and the second gas medium have the same composition and comprise at least one of helium, hydrogen.

5. The LED lamp according to claim 1, wherein the first gas medium and/or the second gas medium comprises helium and oxygen, wherein a volume ratio between helium and oxygen is (2.5~50):(50~97.5).

6. The LED lamp according to claim 1, wherein the first gas medium comprises at least one of helium and hydrogen, and the second gas medium comprises helium and hydrogen, wherein hydrogen is released from a hydrogen releasing agent in the presence of electromagnetic waves.

7. The LED lamp according to claim 1, wherein the LED light source module comprises a support unit and a LED chip mounted on the support unit.

8. The LED lamp according to claim 1, wherein the LED inner vessel comprises a shell made of a material selected from transparent hard glasses or transparent quartz glasses, and the shell is shaped as a sphere, an ellipsoid, a cube, or a cuboid.

9. The LED lamp according to claim 1, wherein the fixing device further comprises a charging and exhausting port for filling the first inner cavity and charging the first gas medium.

10. The LED lamp according to claim 3, wherein the metal pin is configured to fix the LED inner vessel to the driver module.

11. The LED lamp according to claim 7, wherein the support unit comprises at least one support plate or at least one support column.

12. The LED lamp according to claim 7, wherein, the second gas medium comprises hydrogen and helium and the supporting unit is made of a material selected from glasses, ceramics, metals or sapphires.

13. The LED lamp according to claim 7, wherein, the second gas medium comprises hydrogen and oxygen and the supporting unit is made of a material selected from glasses, ceramics, metals or sapphires.

14. The LED lamp according to claim 7 wherein, the second gas medium comprises oxygen and helium and the supporting unit is made of an organic material or a metal-organic compound material.

* * * * *